US005603350A

United States Patent [19]

Stoll et al.

[11] Patent Number: 5,603,350

[45] Date of Patent: Feb. 18, 1997

[54] VALVE STATION

[75] Inventors: Kurt Stoll; Manfred Rüdle, both of Esslingen, Germany

[73] Assignee: Festo KG, Esslingen, Germany

[21] Appl. No.: 522,353

[22] PCT Filed: Jul. 2, 1994

[86] PCT No.: PCT/EP94/02172

§ 371 Date: Nov. 16, 1995

§ 102(e) Date: Nov. 16, 1995

[87] PCT Pub. No.: WO95/02770

PCT Pub. Date: Jan. 26, 1995

[30] Foreign Application Priority Data

Jul. 13, 1993 [DE] Germany ..... 93 10 438.3 U

[51] Int. Cl.[6] ..... F15B 13/08

[52] U.S. Cl. ..... 137/596.16; 137/884

[58] Field of Search ..... 137/596.16, 884

[56] References Cited

U.S. PATENT DOCUMENTS 3,885,284 5/1975 Clippard .
3,993,091 11/1976 Loveless .
4,399,836 8/1983 de Versterre et al. .
4,898,203 2/1990 Kobelt .
5,222,524 6/1993 Sekler et al. ..... 137/884
5,458,048 10/1995 Hohner ..... 137/884 X

FOREIGN PATENT DOCUMENTS 0554713 1/1993 European Pat. Off. ..... 137/884
3740001A 6/1989 Germany .
9211109U 10/1992 Germany .

*Primary Examiner*—Gerald A. Michalsky
*Attorney, Agent, or Firm*—Hoffman & Baron

[57] ABSTRACT

A valve station is suggested which is provided with a fluid distribution device (5) with an equipment panel (8). A plurality of multi-way valves (12) are mounted on the panel (8), which are controlled by an electrically actuable valve drive (16). The multi-way valves (12) are aligned in such a manner that the direction (37) of the switch movement of its given obturator (36) extends rectangularly with respect to panel (8). The fluidic connection of a given multi-way valve (12) with an internal feeding conduit (26) of the fluid distribution device (6) is performed through an orifice (57) of a valve conduit (59) which is provided on the front face (53) of the given multi-way valve (12) opposite of panel (8).

13 Claims, 2 Drawing Sheets

VALVE STATION

SPECIFICATION

Figure 1:
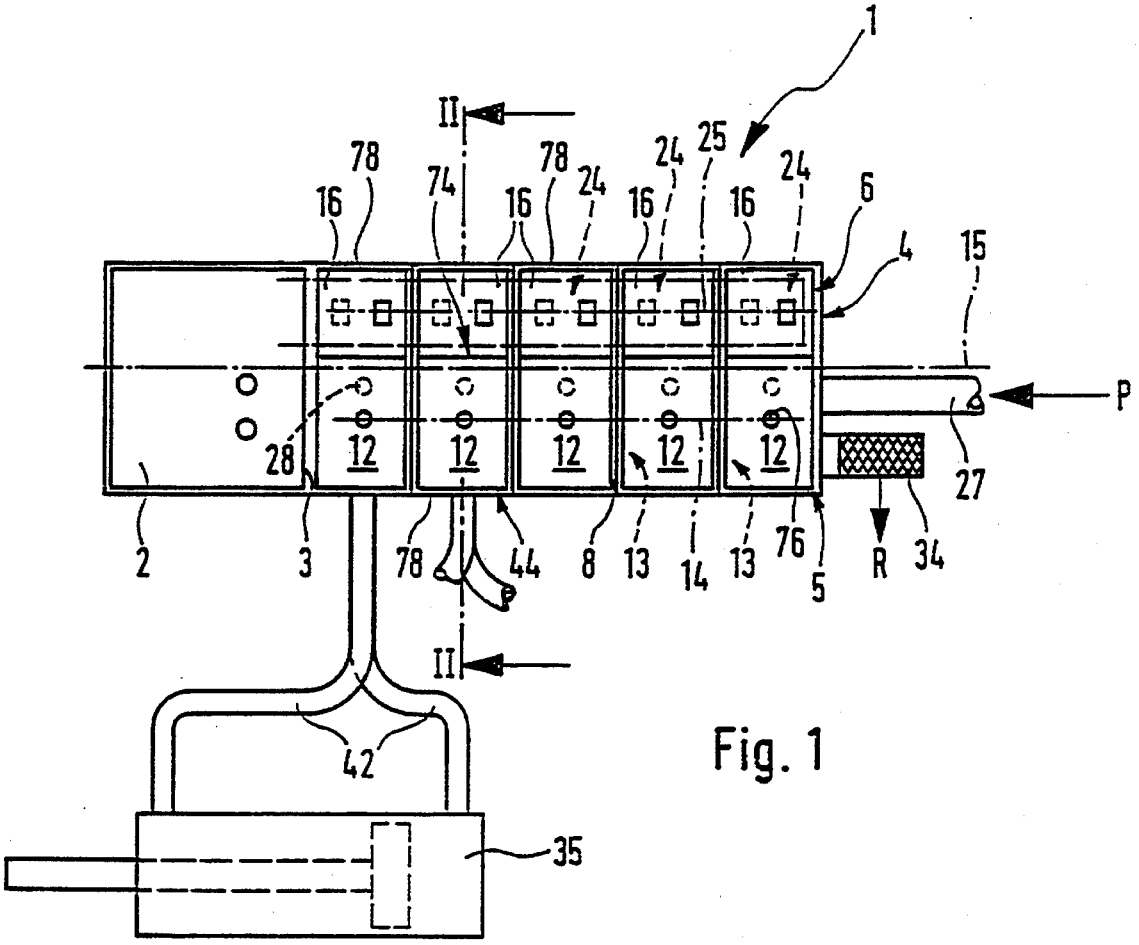

The invention relates to a valve station for use in conjunction with the control of fluid actuable devices such as cylinders having a plate, block or bar-like fluid distribution device.

Valve stations of this type are disclosed in U.S. Pat. No. 4 399 836. Generally they have a panel-like fluid distribution device, which is equipped with a plurality of multi-way valves aligned in a linear row. The supply of the operating fluid is carried out through the fluid distribution device, whereby the operating fluid is compressed air. For actuation, each of the multi-way valves is provided with at lease one valve drive which customarily contains at lease one electromagnet which acts on a control member. These valve drives receive their actuating signals through a signal distribution device extending along the fluid distribution device and communicating with an electronic control device. In this manner different fluid actuable devices of a given plant or device may be controlled centrally from the valve station. As indicated in German petty patent DE-U-92 11 109, such devices have rigid or flexible fluid lines which are connected to the individual multi-way valves.

Because the multi-way valves are practically aligned in a vertical position they require principally only a very low structure width. The supply of the multi-way valves with the required operating fluid is performed through an orifice at the front face of each multi-way valve facing each equipment location, so that a direct fluid connection without any external connecting hoses is made possible, which enhances the compactness of the device.

Although, the known valve station is already built vary compactly, it has been shown to be necessary to provide an even more compact structure in many applications, for example in the printing industry. A reduction in structure would be desirable in width as well as height direction, with respect to the alignment direction of the successively mounted multi-way valves. Thereby, it should be possible to ventilate connected devices through the multi-way valves.

It is therefore an object of subject invention to provide a valve station enabling a more compact structure.

This object is solved by a ventilation conduit being formed in a fluid distribution device extending in a longitudinal direction thereof which communicates through first orifices with valve equipment locations. Each of the first orifices with a front face facing a panel of an associated multi-way valve is connected with a second orifice of a ventilating conduit opposite the associated multi-way valve. A control member of a valve drive controls a control conduit which serves to supply an obturator of the multi-way valve with the required fluid control signals for generating a linear switch movement. A signal distribution device is provided with a series of valve drive equipment locations whose alignment direction is parallel to the alignment direction of the valve equipment locations. The individual valve drives are mounted on one of the lateral housing faces of the given multi-way valve. The valve drives extend from the valve equipment location parallel in the direction of the switch movement of the obturator away from the valve equipment location. In addition, the valve drives are mounted on the valve drive equipment locations of the signal distribution device.

In comparison to the state of the art, a still more compact structure is obtained in this manner and in particular a reduction of the construction height. The ventilation conduit being integrated into the fluid distribution device enables a common ventilation of all connected multi-way valves.

A device is already known from U.S. Pat. No. 4 898 203 with valve drives being laterally mounted on the multi-way valves. However, they are not provided with equipment locations for a signal distribution device. Also a ventilation conduit integrated into the fluid distribution device is missing, because each individual multi-way valve is ventilated upwardly into the atmosphere.

Advantageous further embodiments of the invention are stated in the subclaims.

The device in accordance with the invention enables a particularly simple arrangement of a manual actuation device, since the valve member is already aligned in normal alignment to the panel face, so that one of the two front faces of the multi-way valve is accessible, without obstruction, from above. One may equip the manual actuation device with a simple actuation part which extends from the front face of the valve housing and which immediately acts on the valve member during a manual shifting without any special deflection. Advantageously, the actuation member may be suspended on an elastic membrane with reverse positioning characteristics.

Figure 2:
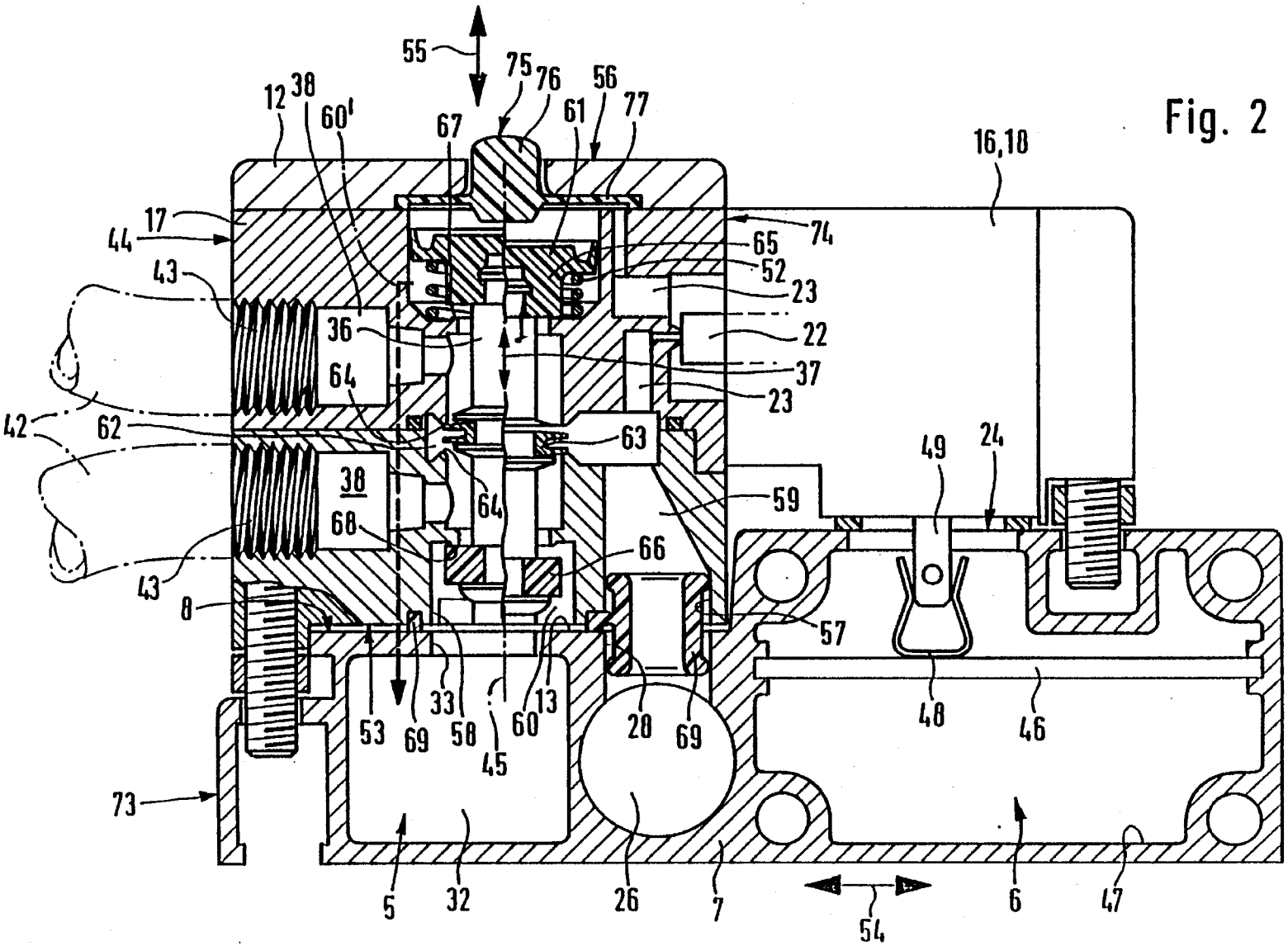

The invention will be described in more detail in the following descriptions read in conjunction with the appended drawings. The drawings show:

FIG. 1 a simplified plan view of a valve station designed in accordance with the principle of the subject invention including a controllable fluid actuable device, whereby further controllable devices are not shown, and FIG. 2 a cross section through the valve station of FIG. 1 in accordance with sectional line II—II, whereby the available valve drive is illustrated in an uncut view for simplicity.

The exemplified valve station 1 is provided with a control part 2 with a block-like shape. A block-like longitudinal distribution device 4 is added on at one connection face 3 of control part 2, being composed of a fluid distribution device 5 for fluid and a signal distribution device 6 for electrical valve actuation signals. By way of example, the distribution device 4 is provided with a distribution housing 7 which functions as a common housing for both distribution devices 5,6.

By way of example, on its upper face, the fluid distribution device 5 is provided with a panel 8 for multi-way valves 12. It is subdivided into a plurality of equipment locations 13 which are arranged successively in one row 14, whereby this row 14 extends parallel to the longitudinal axis 15 of the distribution device 4. One multi-way valve 12 may be detachably mounted on each valve equipment location 13. In the exemplified embodiment, five valve equipment locations 13 are provided, each equipped with one multi-way valve 12.

Each multi-way valve 12 is equipped with at least one valve drive 16 which in particular is directly mounted to the corresponding valve housing 17. As previously mentioned, each valve drive 16 is controlled by the valve actuating signals which are supplied by the signal distribution device 6. By way of example, the valve drives 16 are formed by an electromagnet device 18, whereby the magnet coil (not shown) can move a control member 22, which acts as an abturator and which also controls a control conduit 23 of the associated multi-way valve 12. Each valve drive 16 is mounted on a valve drive equipment location 24 on signal distribution device 6 extending transversely to the longitudinal axis 15 adjacent to the valve equipment location 13 of the associated multi-way valve 12. Correspondingly, there is also a linear row of valve drive equipment locations 24 provided, whereby the row direction 25 extends parallel to the row direction 14.

A feeding conduit 26 extends within fluid distribution device 5, parallel to longitudinal axis 15. It discharges, on the one hand, at the front face of distribution housing 7 opposite control part 2, where a fluid line is connected leading to a pressure medium source. On the other hand, it is associated commonly with all multi-way valves 12, in that it discharges to each valve equipment location 13 through branch conduits. The corresponding orifices are indicated at 28. In the same manner the distribution housing 7 has a discharge or ventilation conduit 32 which, on the one hand, discharges on the same front face as feeding conduit 26, so that a sound absorber 34 or a further ventilation line may be connected. On the other hand, the ventilation conduit 32 is also provided with orifices 33 which open to a given valve equipment location 13. The feeding conduit 26 and the ventilation conduit 32 are designed as collection conduits through which the multi-way valves 12 are supplied with operating fluid or are ventilated. By this operation, fluid actuable devices 35, which are connected to the multi-way valves 12, are actuated. For illustrative purposes, such a fluid actuable device 35 is indicated in the form of an operating cylinder in FIG. 1.

The type and manner of the actuation of the connected fluid actuable device 35 depends on the switch condition of the associated multi-way valve 12. Each multi-way valve 12 has an associated obturator 36, within its valve housing 17, which is able to perform a linear reciprocating switch movement. The direction of the switch movement is indicted by a double arrow 37 in FIG. 2. The obturator 36 controls two consumption conduits 38 per multi-way valve 12, in the exemplified embodiment, which discharge through two consumption connection openings 43 to an outer housing face 44 of valve housing 17. Rigid or elastic detachable fluid lines 42 may be connected to the fluid actuable device 35. In the exemplified embodiment the obturator 36 may assume two switch positions which in FIG. 2 are indicated on both sides of its symmetric axis forming longitudinal axis 45, so that operating fluid is fed alternately to either the one or the other consumption connection opening 43, while through the other a ventilation of the connected device 35 is performed.

The switch movement of obturator 36 is caused by fluid control signals which are supplied by the feeding conduit 26 in dependency from the position of set member 22. The same, in return, depends from the operating condition of the associated valve drive 16 which is influenced by the valve actuating signals. These valve actuating signals are generated immediately in the control part 2, in the exemplified embodiment, which is equipped with a programmable control device. The corresponding signals are conducted through signal conductors, not shown in detail, of the signal distribution device 6 to the individual valve drive equipment locations 24 where they are picked up by the given valve drive 16. By way of example, the signal transmission is performed by means of a conductor plate device 46 which extends in a hollow space 47 of distribution housing 7 from control part 2 in row direction 25 and is provided with electric plug contact means 48 in the area of each given valve drive equipment location 24 being engaged by the mounted valve drives 16 with complementary plug contact means 49. Individual flexible signal conductors may be used instead of the conductor plate arrangement.

The multi-way valves 12 are switched during operation in accordance with the setting of the control program in control part 2, so as to operate the connected fluid actuable devices in a desired manner. The control unit need not necessarily be integrated in control part 2, but may be designed separately, so that the control part merely operates as a distribution station. For example, the control part 2 may be a field bus communication unit.

The valve station is constructed very compactly since the multi-way valves 12 are mounted on the associated valve equipment locations 13 in such a manner that the aforementioned direction 37 of the switch movement of the associated obturator 36 extends at a right angle to the equipment face 8. A given valve housing 12 is mounted in such a manner that it is positioned with one of its two axial front faces 53 on the associated valve equipment location 13. The normal direction of the panel 8 coincides with the longitudinal direction 45 of obturator 36. Consequently, a very small construction width of valve station 1 in the area of the distribution device 4 is obtained, with respect to the width direction extending parallel to the panel 8 and at a right angle to the longitudinal axis 15 as indicated by double arrow 54. Surprisingly, this reduction in construction width does not result in a disadvantageous enlargement of the construction height of valve station 1 which is measured at a right angle with respect to the panel 8 in height direction 55. The reason is that simultaneously the consumption connection orifices 43 are provided on a first lateral housing face 44 of valve housing 17, that is, at one of those housing faces, with a first front face 53, facing panel 8 and extending upwardly 58. The connected fluid lines 42 may also extend laterally, so that they do not extend beyond the structural height of the multi-way valve 12. If the consumption connection orifices 43 were provided on the second front face 56 of valve housing 17, facing away from panel 8, one would have to mount the connected fluid lines curve-like upwardly and simultaneously laterally so that the fluid lines would considerably increase the height of the structure.

The compactness of the total device is further enhanced in that the orifices 28,33 in the area of the valve equipment locations 13 communicate immediately with orifices 57,58 of valve conduits 59,60 of the given multi-way conduit 12, in that orifices 57,58 are formed on the first downwardly extending front face 53 and are arranged in such a manner that they are located opposite the distribution side orifices 28,33. Hence, no external connection lines are required.

The valve conduit 59 which communicates in this manner with feeding conduit 26 is connected with either the one or other consumption conduits 38, provided in the valve, depending on the switch position of obturator 56. In the exemplified embodiment, a further valve conduit branches within valve housing 17 from valve conduit 59 which forms the previously mentioned control conduit 23. The fluid passage through the same is either interrupted or released depending on the position of the control member 22. If it is released the fluid admits an actuation piston 61 in the area of the second front face 56 which is in contact with obturator 36. Thus, the obturator 36 is moved against the force of a return spring 52 from a first switch position into a second switch position in direction to the panel 8. During an interrupted fluid passage of control conduit 23 the return spring 52 moved the obturator 36 back into the first switch position. Obviously, the multi-way valves 12 of the exemplified embodiment are only controlled during one movement direction. However, it would also be possible to provide an obturator 36 which is controllable in both directions, whereby two valve drives could be associated with one multi-way valve 12. A contribution to the compactness of the device is provided by the fact that the ventilating conduit 60 is formed by the recess 62 which receives the obturator 36 in the end section associated with the first front face 53. The recess 60 is open towards the first front face 53 and is located opposite the orifice 33.

The multi-way valves 12 used in the exemplified embodiment are characterized by a very good sealing effect with respect to their obturators 36. This sealing effect is a beneficial consequence of these obturators being designed as seat valve members. In the exemplified embodiment, the longitudinal obturator 36 is provided with a central sealing element 63 which cooperates with one of the two consumption conduits 38 selectably with one of two annular-like valve seats 64 for connecting the ventilation conduit 59. Axially on both sides thereof this sealing element 63 is flanked by two further sealing elements 65,66. These elements produce a connection between one of the consumption conduits 38 and orifice 33 depending on their position, whereby one each valve seat 67,68 are associated therewith. In height direction 55, the two consumption conduits 38 are arranged in a superimposed manner. The lower one is ventilated through orifice 58, the upper one through ventilation conduit 60', indicated by a dashed line, whose connection with ventilation conduit 32 in the area of the associated valve equipment location 13 is also performed through a flush pair of orifices, which are not shown in detail in the drawing.

It is to be understood that one or a plurality of sealing devices 69 are provided between the adjacent associated pairs of orifices in the area of the valve of the valve equipment locations 13 which assure a leak free flow.

The valve housing 17 of the exemplified multi-way valves 12 have a square like outer contour. They are mounted on the fluid distribution device 5 in such a manner that the aforementioned first lateral housing face 44 is connected flush with a longitudinal outer face 73 of the distribution housing 7. The valve drives 16 are flanged on a second lateral housing face 74 of a given valve housing 17 opposite the first lateral housing face 44, whereby the control member 22 is aligned so that its actuation direction extends rectangularly with respect to the longitudinal axis 45 of obturator 36. The normal vectors of the two lateral outer faces 44,74 are also extending rectangularly with respect to the row direction 14 in a width direction 54.

Since the multi-way valves 12 are practically in a vertical position, their upwardly directed second front faces 56 are easily accessible from above. For this reason, if necessary, a manual actuation device 75 may be provided with which the obturator may be manually actuated. The exemplified manual actuation device 75 is provided with an actuating part 76 which extends out of the front face of the housing and which is movably suspended on an elastic membrane 77 within the housing in accordance with double arrow 37. It is located coaxially with respect to the obturator 36, facing the front face, and is unitarily formed with the membrane. In particular, it is a unitary plastic or rubber part. If one presses with the finger on the actuating part 76, it is moved in the direction 37 of the switch movement, and admits the obturator 36 and moves the same into the second switch position.

The two distribution devices 5,6 may be provided with separate housings which advantageously are rigidly connected with each other. However the common housing construction has technical manufacturing advantages.

The exemplified distribution device 4 has a modular structure. A multitude of distribution modules 78 are available which are provided with one or a plurality of valve equipment locations 13 and valve drive equipment locations 24. The distribution modules 78 are advantageously rigidly connected with each other successively in longitudinal direction 15, for example, by means of screw connections. In this manner distribution devices 4 of any given construction length can be realized and changed with mechanical assembly units.

We claim:

1. Valve station for use in conjunction with the control of fluid actuable devices (35) having a panel (8) being subdivided into a plurality of successive valve equipment locations (13) each being equipable with one multi-way valve (12), having an obturator (36) drivable for a switch movement and at least a consumption connecting opening (43) on the outer face of the valve housing (17) which is not facing the panel (8), for connection with a fluid line (42) leading to a fluid actuable device (35), whereby in the longitudinal direction of the fluid distribution device (5) at least one feeding conduit (26) extends communicating, on the one hand, with a fluid source and, on the other hand, through orifices (28) with a plurality of the valve equipment locations (13) and thereby with the multi-way valves (12), and a signal distribution device (6) having signal conductors extending along a row of valve equipment locations (13) being used to transmit valve actuating signals from an electronic control device through the signal conductors to an electrically actuable valve drive (16) which is equipped with one multi-way valve (12) and having a movable control member (22), whereby at least one multi-way valve (12) of the valve station (1) is arranged on the panel (8) of the fluid distribution device (5) in such a manner that the direction (37) of the switch movement of the given obturator (36) is aligned at a right angle with respect to the panel (8) and that the fluidic connection is performed through the internal feeding conduit (26) of the fluid distribution device (5) and through an orifice (57) of a valve conduit (59) of the given multi-way valve (12) on a front face (53), facing the panel (8), and said orifice (57) positioned opposite orifice (28) of feeding conduit (26), characterized in that a ventilation conduit (32) is formed in said fluid distribution device (5) extending in a longitudinal direction thereof which communicates through orifices (33) with said valve equipment locations (13), whereby each of said orifices (33) with a front face (53) facing the panel (8) of said associated multi-way valve (12) is connected with an orifice (58) of a ventilating conduit (60) opposite said associated multi-way valve (12), that said control member (22) of said valve drive (16) controls a control conduit (23) which serves to supply said obturator (36) of said multi-way valve (12) with the required fluid control signals for generating a linear switch movement (37), that said signal distribution device (6) is provided with a series of valve drive equipment locations (24) having an alignment direction (25) that is parallel to the alignment direction (14) of valve equipment locations (13), and that the individual valve drives (16) are mounted on one of the lateral housing faces (74) of the given multi-way valve (12), on the one hand, extending from said valve equipment location parallel in the direction (37) of the switch movement of said obturator (36) away from valve equipment location (13) and, on the other hand, being mounted on the valve drive equipment locations (24) of said signal distribution device (6).

2. Valve station in accordance with claim 1, characterized in that said signal distribution device (6) is provided with a printed circuit board (46) for signal transmission.

3. Valve station in accordance with claim 1, characterized in that on a front face (56) of said given multi-way valve (12) facing said associated valve equipment location, a manual actuating device (75) is provided for a manual valve actuation which has an actuating part (76) extending from valve housing (17) which can coact with said obturator (36) during the displacement in the direction (37) of said obturator (36).

4. Valve station in accordance with claim 3, characterized in that said actuating part (76) is suspended movably on said housing (17) of said multi-way valve (12) by means of an elastic membrane (77).

5. Valve station in accordance with claim 4, characterized in that said actuating part (76) is unitarily formed with said membrane (77).

6. Valve station in accordance with claim 1, characterized in that the consumption connecting openings (43) are provided on one of the lateral housing faces (44) of said given multi-way valve extending from said valve equipment location (13) parallel to the direction (37) of said switch movement away from said valve equipment location (13).

7. Valve station in accordance with claim 6, characterized in that said valve drives (16) and said consumption connecting openings (43) are disposed on opposite faces of said valves (12).

8. Valve station in accordance with claim 1, characterized in that said obturator (36) of a given multi-way valve (12) is formed at least partially as a valve seat member.

9. Valve station in accordance with claim 1, characterized in that said fluid distribution device (5) and said signal distribution device (6) have a common distribution housing (7).

10. Valve station in accordance with claim 1, characterized in that said signal distribution device (6) is provided with a plurality of successively mounted equipment locations (13) for valve drives (16), whereby one valve drive equipment location (24) is located adjacent to a valve equipment location (13) of said fluid distribution device (6).

11. Valve station in accordance with claim 1, characterized in that said fluid distribution device (5) and said signal distribution device (6) are mounted on a control part (2) of said valve station (1).

12. Valve station in accordance with claim 1, characterized in that said fluid distribution device (5) and said signal distribution device (6) are constructed module-like and consist of a plurality of detachably assembled distribution modules (78).

13. Valve station in accordance with claim 1, characterized in that a distribution device (4) is provided and composed of said fluid distribution device (5) and said signal distribution device (6), which at one of the equipment faces provides two adjacent rows of equipment locations (13, 24) for said multi-way valves (12) and said valve drives (16).

* * * * *